US005655970A

United States Patent [19]

Jäger

[11] Patent Number: 5,655,970

[45] Date of Patent: Aug. 12, 1997

[54] PLASTIC PIN

[76] Inventor: Arnold Jäger, Gehrbergsweg 6, 31303 Burgdorf, Germany

[21] Appl. No.: 459,117

[22] Filed: Jun. 2, 1995

[30] Foreign Application Priority Data

Jul. 28, 1994 [DE] Germany ..... 44 26 728.2

[51] Int. Cl.[6] ..... A63D 9/00

[52] U.S. Cl. ..... 473/118; 473/119

[58] Field of Search ..... 473/118, 119, 473/120, 121, 122, 123, 124

[56] References Cited

U.S. PATENT DOCUMENTS 1,583,824 5/1926 Bishop ..... 473/119
3,044,777 7/1962 Friedman ..... 473/119
3,169,766 2/1965 Ernst ..... 473/119
3,572,710 3/1971 Negrini ..... 473/119
3,971,837 7/1976 Hasegawa et al. ..... 473/119

*Primary Examiner*—William M. Pierce
*Attorney, Agent, or Firm*—Robert W. Becker & Associates

[57] ABSTRACT

A plastic pin having a porous and/or cellular core that is surrounded by a hard shell. To be able to influence the level of the center of gravity of the pin, the shell is provided with an aperture in which is secured an insert in the form of a hollow body that extends into the interior of the shell and is disposed coaxially thereto. The hollow body can extend from the head of the pin beyond the neck and into the upper portion of the barrel portion of the pin.

15 Claims, 1 Drawing Sheet

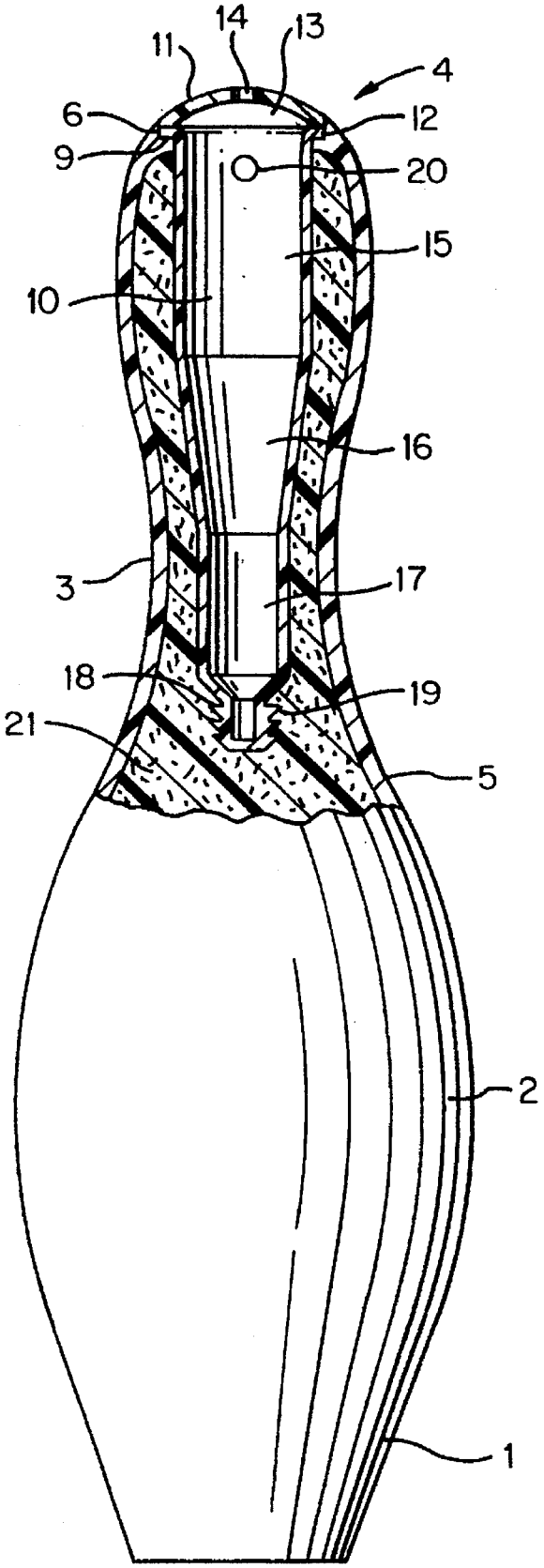
14
13
11
4
6
12
9
20
15
10
16
3
17
18
19
21
5
2
1

PLASTIC PIN

BACKGROUND OF THE INVENTION

The present invention relates to a plastic pin, including a so-called bowling pin, for bowling lanes, with the pin having a cellular and/or porous core that is surrounded by a hard shell.

With pins of this type, not only is the total weight important, but also the height or level of the center of gravity, since the latter has a significant impact upon the tipping characteristic of the pin.

It is an object of the present invention to provide for pins of the aforementioned general type features that enable one to influence the level of the center of gravity without negatively impacting the durability of the pin.

BRIEF DESCRIPTION OF THE DRAWING

This object, and other objects and advantages of the present invention, will appear more clearly from the following specification in conjunction with the accompanying schematic drawing, which is a partially broken away view showing one exemplary embodiment of the inventive pin.

SUMMARY OF THE INVENTION

The pin of the present invention is characterized primarily in that the shell is provided with an opening or aperture in which is secured a hollow body that projects into the interior of the pin and is disposed coaxially thereto, with the hollow body being surrounded by the core material and in the vicinity of the aperture forming a portion of the outer surface of the pin. The hollow body is expediently disposed in the upper portion of the pin, with the uppermost location of the head of the pin being provided with the aperture so that the hollow body can project downwardly into the pin from above.

The hollow body provided by the present invention offers the possibility of being able to affect portions of the weight of the pin body, preferably in the head region but possibly also in the vicinity of the base. The hollow body could also be provided with a filling, although normally the hollow body contains no filling so that the interior of the hollow body communicates with the atmosphere, i.e. is filled only with air.

The inventive hollow body, which forms a so to speak insert, is made of a rigid plastic, for example having a polyamide base, and is inserted into the shell after the latter has been produced. The hollow space of the shell is thereupon filled with the core material, as a consequence of which the hollow body is also surrounded by the core material. In order to provide a positive connection between the hollow body and the core material, the hollow body can be provided with projections, undercuts, and the like, as a result of which an additional anchoring of the hollow body is also produced, and in particular in addition to the connection of the hollow body to the shell in the vicinity of the aperture of the shell.

Further specific features of the present invention will be described subsequently.

DESCRIPTION OF PREFERRED EMBODIMENTS

Referring now to the drawing in detail, the pin is provided above its base 1 with a barrel portion 2, above which is disposed a neck 3 and at the top a head 4. In a manner known per se, the neck 3 has a smaller outer diameter than does the head 4, which in turn has a smaller diameter than the diameter of the barrel portion 2. For all practical purposes, the exterior configuration of the pin is determined by the shell 5, which is made of a hard plastic, preferably a plastic having a polyamide base. The shell is expediently produced by blow molding. Special fittings can also be provided on the base 1 in order to make it easier to stand the pin upright.

At the uppermost location of the head 4, the latter is centrally provided with an opening or aperture 6 having a circular configuration. That edge of the aperture 6 that faces the interior of the shell 5 is provided with an annular, circumferential projection 9 that thus forms a shoulder. Placed into the aperture 6 is an insert in the form of an elongated essentially hollow-cylindrical hollow body 10 that thus extends into the interior of the shell 5, although the upper end 11 is flush with the outer surface of the shell 5, so that in the region of the head the upper end 11 forms the outer surface of the pin. For this reason, the upper end of the hollow body 10 is convexely arched outwardly in conformity with the head 4.

The upper end of the hollow body 10 is additionally provided with a circumferential rib 12 that engages the shoulder at the top of the shell 5 and rests upon the projection 9. The dome or arch 13 at the top of the hollow body 10 is provided in the middle with a hole 14 that leads to the interior of the hollow body 10. Adjoining the rib 12 and extending downwardly therefrom is a cylindrical portion 15 that is followed by a conical portion 16 that merges with a further cylindrical portion 17. The bottom of the hollow body 10 is closed off by a nipple-like extension 18, the outside of which is provided with circumferential triangular ribs 19 to thereby form a sawtooth-like profile, the inclined portions of which extend upwardly at an angle.

In view of the unique configuration described above, the hollow body 10 has a slightly conical shape, extending beyond the region of the neck 3 into the upper portion of the barrel portion 2. The outer diameter of the hollow body 10 is such that its outer surface is spaced from the inner surface of the shell 5. This spacing can range from about 8 to 15 mm.

The head portion of the hollow body 10, which preferably has a polyamide base, is positively connected to the shell 5 by means of the shoulder configuration. However, an additional connection is provided by gluing or the like, although such gluing is not provided over the entire circumference of the shoulder, but rather over only a portion of the circumference, such as by successive spots of adhesive.

After the shell 5 is produced, the hollow body 10 is inserted therein and secured in the aforementioned manner. The space between the shell 5 and the hollow body 10 is thereupon foamed out from the bottom via the support surface of the base 1 to thereby form a porous and/or cellular core 21 that is made of a plastic with which is mixed an expanding agent, said plastic having, for example, a polypropylene base to which can be added glass fibers, and which can amount to about 25–50% by volume of the entire mass that is to be introduced into the shell 5. The rising foam also embraces the nipple 18 and thereby forms a positive connection to the hollow body 10. Venting is effected by the aforementioned, non-glued peripheral portions of the elements 9 and 12. Instead of venting in this fashion or in addition thereto, the vicinity of the upper end of the hollow body 10 can also be provided with one or more holes 20 so that the venting can be effected first via these holes 20 and from there to the atmosphere via the hole 14.

Since the hollow body 10, with a wall thickness of only about 2–3 mm, does not form a filled hollow space within the shell 5, the center of gravity of the pin is thus displaced downwardly so that a load distribution in the head portion of the pin is precluded.

When the pin is finished, the hole 14 can remain or can also be closed off.

The present invention is, of course, in no way restricted to the specific disclosure of the specification and drawing, but also encompasses any modifications within the scope of the appended claims.

What I claim is:

1. A plastic bowling pin for bowling lanes of the type having a head, a neck and a barrel portion formed from a hard outer shell containing a cellular and/or porous material, said pin further comprising;

an aperture at an upper end of said head through said shell, a hollow body that is secured at one end to and extends from said aperture coaxially, relative to an axis of said pin, into an interior of said shell through the region of said neck to the beginning portion of said barrel portion only and with said hollow body being surrounded by said cellular and/or porous material.

2. A pin according to claim 1, wherein said hollow body is essentially hollow cylindrical.

3. A pin according to claim 1, wherein said hollow body tapers slightly downwardly in a conical fashion.

4. A pin according to claim 1, wherein said shell has a circumferential projection adjacent to in the said aperture, and wherein said hollow body, has a circumferential rib that rests upon said projection of said shell.

5. A pin according to claim 4, wherein in the vicinity of said aperture said shell has a stepped configuration and said hollow body has a complementary configuration.

6. A pin according to claim 1, wherein said hollow body and a rim of said aperture are connected together by gluing.

7. A pin according to claim 6, wherein spaced-apart glue spots are provided between said hollow body and said aperture so as to provide vent openings between said glue spots.

8. A pin according to claim 1, wherein said hollow body is provided with projections on an exterior surface that are positively connected to said cellular and/or porous material material.

9. A pin according to claim 8, wherein said projections of said hollow body have a saw tooth configuration, with inclined surfaces of said projections being directed upwardly at an angle.

10. A pin according to claim 8, wherein said projections of said hollow body are disposed at a lower end of said hollow body remote from said aperture.

11. A pin according to claim 1, said outer surfaces of said hollow body are spaced from adjacent inner surfaces of said shell.

12. A pin according to claim 11, wherein said spacing between said outer surfaces of said hollow body and said inner surfaces of said shell are about 8–15 mm.

13. A pin according to claim 10, wherein said lower end of said hollow body is provided with a nipple-like extension having a diameter that is less than a diameter of an adjacent portion of said hollow body, and wherein said projections of said hollow body are disposed on said nipple-like extension.

14. A pin according to claim 1, wherein said hollow body has an upper, arched portion that is disposed in said aperture and closes off an upper end of said hollow body, said arched portion being provided with a hole.

15. A pin according to claim 14, wherein an upper end of said hollow body is provided with a first hole that communicates with the atmosphere, and is also provided with at least one second hole that provides communication between said interior of said shell and an interior of said hollow body to allow venting of said interior of said shell via said hollow body.

* * * * *